United States Patent [19]

Leumann

[11] 4,145,259

[45] Mar. 20, 1979

[54] CLOSURE MEMBERS

[75] Inventor: Hans E. Leumann, Washington, Pa.

[73] Assignee: Bloom Engineering Company, Inc., Pittsburgh, Pa.

[21] Appl. No.: 804,909

[22] Filed: Jun. 9, 1977

[51] Int. Cl.[2] ..... B65D 45/28; B65D 53/10; C10B 25/16

[52] U.S. Cl. ..... 202/248; 16/163; 49/483; 110/173 R; 202/242; 220/314; 220/344; 292/260

[58] Field of Search ..... 16/163, 164; 220/314, 220/4 A, 333, 71, 244, 329, 332, 344; 202/246, 247, 248, 242, 269; 110/173 R, 173 A, 173 B; 292/259 R, 260, 257; 277/236, 169; 49/483, 485; 277/199

[56] References Cited

U.S. PATENT DOCUMENTS

| | | | |
|---|---|---|---|
| 204,576 | 6/1878 | Jamin | 202/247 |
| 248,631 | 10/1881 | Balmorf | 202/247 |
| 309,938 | 12/1884 | Farnum | 292/260 |
| 725,745 | 4/1903 | Moore | 202/248 |
| 1,109,828 | 9/1914 | Goff | 220/314 |
| 1,956,665 | 5/1934 | Cahall | 220/314 |
| 1,973,461 | 9/1934 | Barringer | 49/483 |
| 2,154,545 | 4/1939 | Thwaits | 220/314 |
| 2,162,446 | 6/1939 | Scott | 220/314 |
| 2,273,186 | 2/1942 | Fischer | 220/327 |
| 2,442,391 | 6/1948 | Wilputte | 292/256 |
| 3,172,825 | 3/1965 | Maloney | 202/248 |
| 3,352,006 | 11/1967 | Satoh et al. | 277/236 |
| 3,526,409 | 9/1970 | Heinlein | 277/169 |

FOREIGN PATENT DOCUMENTS

| | | | |
|---|---|---|---|
| 1433401 | 11/1966 | France | 220/314 |
| 268313 | 8/1927 | United Kingdom | 202/248 |

*Primary Examiner*—William Price
*Assistant Examiner*—Allan N. Shoap
*Attorney, Agent, or Firm*—Webb, Burden, Robinson & Webb

[57] ABSTRACT

A closure for an opening into a combustion chamber or a distillation chamber which tightly seals said opening. The closure has a central portion with a lip at its periphery having at least one sealing surface thereon. A member adjacent to the opening has a seat portion located out of proximity of said opening which contacts the sealing surface of the lip when the closure is closed. A hinge mechanism mounting the closure adjacent to the opening and permitting removal of the closure from the opening and a locking lever supported adjacent to the opening to force the sealing surface of the lip against the seat portion to seal the opening when the closure is closed. The seal is located out of proximity of a passageway in communication with the opening.

13 Claims, 8 Drawing Figures

CLOSURE MEMBERS

My invention relates generally to a closure for closing an opening into a combustion chamber or a distillation chamber and, more particularly, to a closure for coke oven leveler and stand pipe openings.

In the operation of a coke oven distillation chamber or a furnace combustion chamber, volatile effluents are created by reactions within the chamber. It is imperative that these effluents do not escape into the atmosphere except through the furnace or the oven stacks which are equipped with suitable pollution control equipment. In this regard, an important and specific application for the closure of my invention is to positively seal leveler openings and stand pipe openings of coke ovens. Leveler openings are located at the top of each coke oven pusher door, and each leveler opening is provided with a door or closure which is opened to permit insertion of a leveler bar to level the top surface of the coal charge in the oven prior to coking. When a leveler bar is withdrawn from the oven the leveler opening is closed by a leveler door and a positive seal must be created between the door and the door frame to prevent effluents from escaping into the atmosphere around the leveler door during the coking process. The stand pipe openings in coke ovens are located at the top of the oven and permit venting the oven during pushing and cleaning the ascension pipes.

The maintenance of a positive seal during repeated coking processes is difficult because gases and distillation products are formed which result in the condensation of tar and other deposits on and around the leveler opening frame and the stand pipe cap seat. Additionally, if sulfur bearing coal is charged into a coke oven, corrosive gases are evolved which must not be permitted to escape from the oven. The same conditions require a tight seal by the stand pipe caps.

In the past, coke oven leveler and stand pipe openings have included a frame which is intended to create a smooth machined seat around the openings. The leveler door and stand pipe cap of prior art arrangements include a portion having an edge which cooperates with the seat portion of the frame in an attempt to tightly seal the opening when the door or cap is closed. This arrangement does not provide a tight seal for repetitive closings because of the accumulation of distillation byproducts on the seat portion of the frame which receives the sealing edge of the door or cap when in the closed position. In an attempt to overcome this problem, the seat portion of the door or cap frame is periodically cleaned either mechanically or with high pressure water in an attempt to remove deposited material. Cleaning the seat portion of the frame is both time consuming and expensive and does not result in a completely smooth and clean seat portion which can affect a positive seal with the sealing edge of the closure member.

With todays emphasis on ecology and speciifcally on clean air, it is extremely important to prevent the escape of effluents from a furnace combustion chamber or a coke oven distillation chamber directly into the atmosphere. A consistently tight seal between a closure and the seat therefor is essential. My invention provides a closure and a seat therefor which creates a positive seal to prevent the discharge of effluents into the atmosphere from a combustion or distillation chamber. The arrangement of my invention locates the seat portion of the frame which receives the sealing edge of the closure out of proximity of direct contact with distillation products from a coke oven or products of combustion from a combustion chamber and, hence, corrosion is decreased. My invention provides an arrangement wherein problems which have been encountered with existing closures and seals are substantially overcome.

The closure of my invention has a hinge and latch mechanism to secure the closure in the closed position whereby compressive force is supplied to the closure in the closed position to force the closure toward the opening and cause the sealing surface of a lip on the closure to securely embrace the seat portion of the opening frame. The seal is located in an area remote from the passage of effluents through the opening. The portion of the closure which faces inwardly may be made of stainless steel or other corrosion resistant material which results in a longer life for the closure and thereby reduces maintenance. The sealing element or components thereof may be made of two interacting alloys. Alternatively, the components of the sealing elements may be made of a low grade material so as to be disposable.

Figure 1:
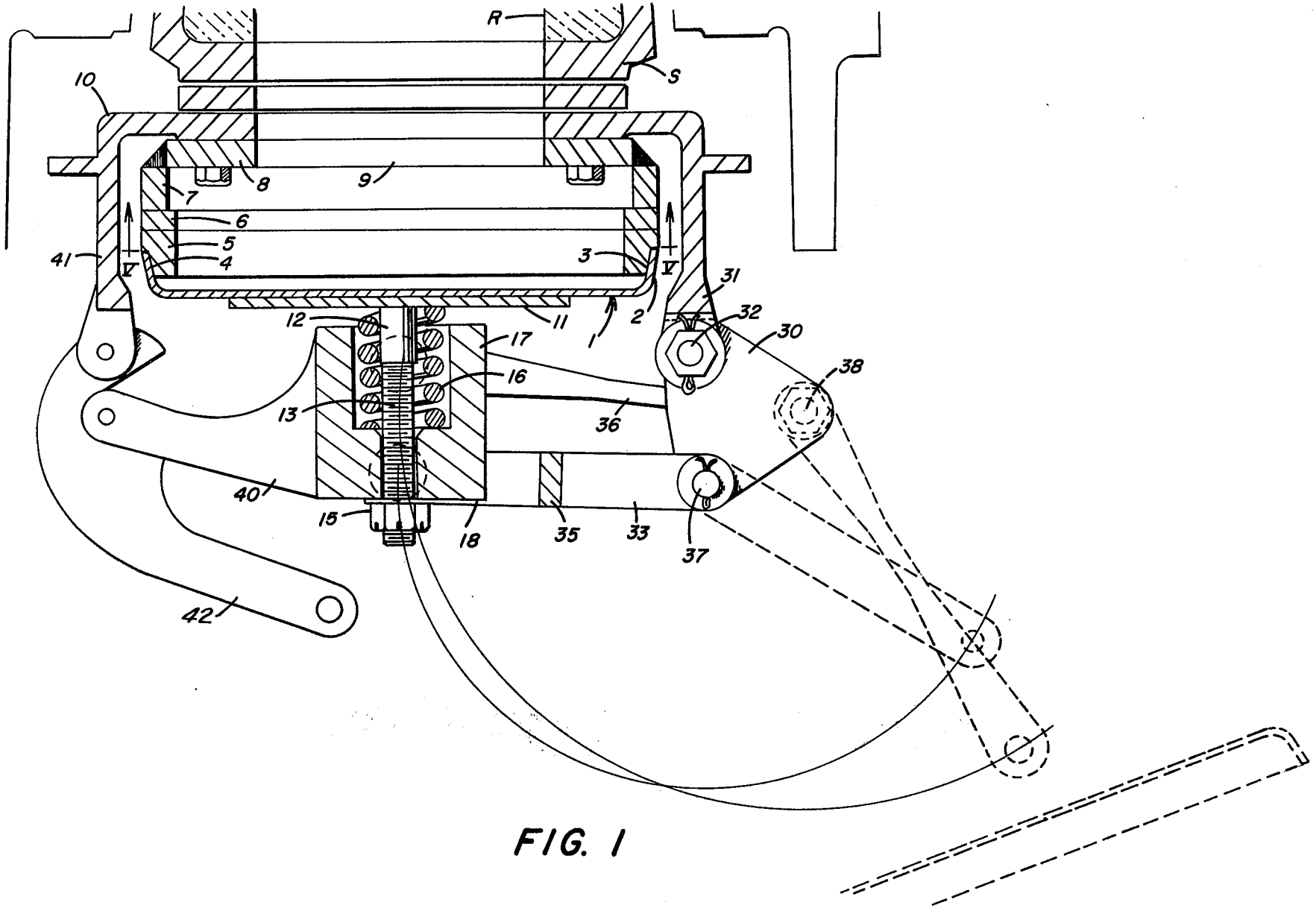
FIG. 1 is a horizontal section through one embodiment of my invention.
Figure 3:
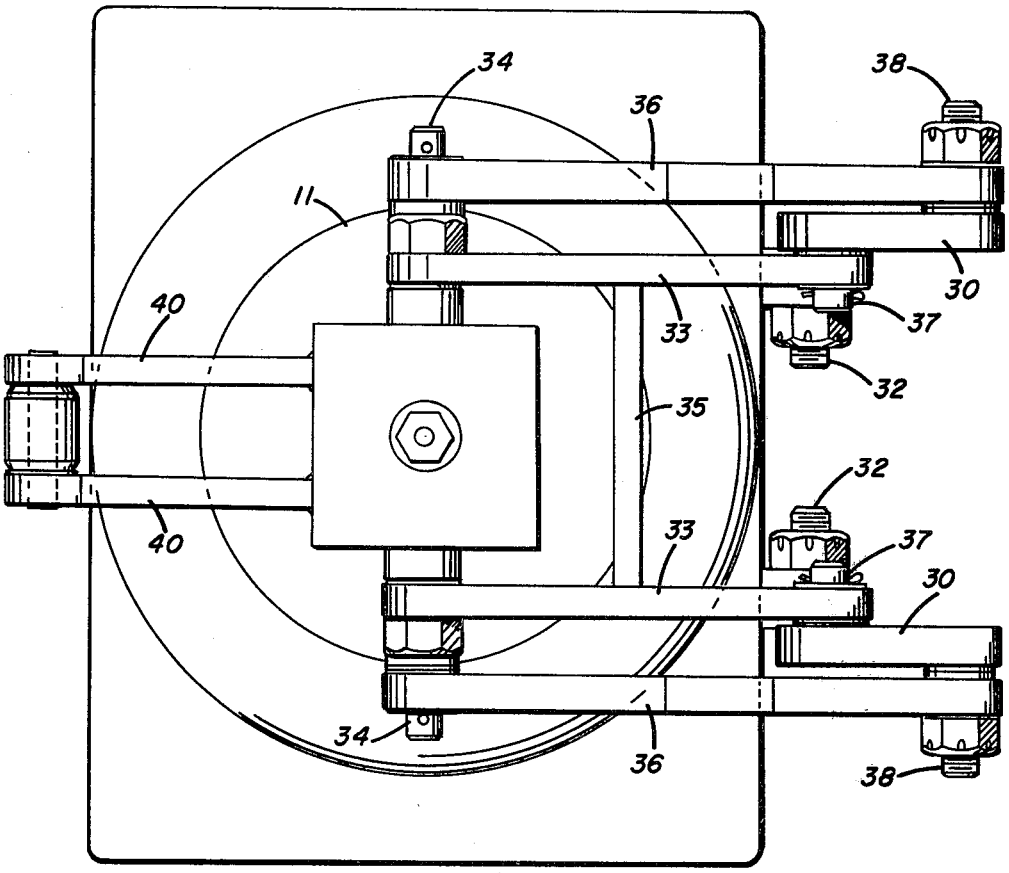
FIG. 3 is a rear elevation of the closure member shown in FIG. 1 including the hinge and latch mechanism.

Referring to the drawings, FIG. 1 shows a construction according to my invention wherein a cone seal tightly closes a coke oven leveler opening. The closure 1 is substantially circular as shown in FIG. 3 and has a central portion 12 with a lip 2 at its periphery and an inwardly facing sealing surface 3 which contacts the seat portion 4 of an annular extension 5 when closure 1 is in the closed position. Annular extension 5 is attached to a transition member 6 which is attached to a spacer 7. Spacer 7 is welded to a member 8 which has an opening 9 formed therein. The configuration of opening 9 matches the configuration of the opening in the pusher door 10 which will generally be square or rectangular. Member 8 is bolted to the exterior of pusher door 10 which is located on the pusher side of the coke oven. The door 10 carries an elongated refractory portion R which extends into the coke oven and which is surrounded on its exterior by a metal shield S. The hinge and latch mechanisms for the closure are supported on pusher door 10 in a manner to be described hereinafter. Alternatively, the hinge mechanism may be supported directly from transition member 6 or spacer 7.

The transition member 6 has a circular opening or an oval opening formed therein which converts opening 9 from a square or rectangular configuration to a round or oval configuration or a configuration which will cooperate with the leveler bar smoke shield.

Figure 5:
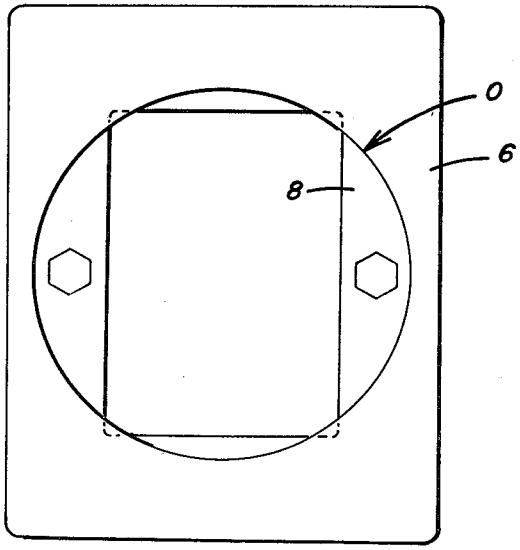
FIG. 5 is a section taken on lines V—V in FIGS. 1 and 2.

FIG. 5 of the drawings shows the member 8 bolted to the pusher door. Member 8 has a rectangular opening 9 formed therein which corresponds with the opening in the pusher door. The spacer 7 is attached to member 8 and transition member 6 is attached to spacer 7. Transition member 6 is formed with a central circular opening 0, and annular extension 5 has a circular opening complementary to the opening in member 6. The closure is circular and cooperates with the circular opening formed by annular extension 5. The circular openings in members 5 and 6 must be large enough to encompass substantially all of the openings in the pusher door and in member 8 so that the openings can accommodate a leveler bar.

The central portion 12 of closure 1 has a circular hub 11 attached to its outer surface to impart rigidity to the central portion of the closure. The hub 11 has an elongated stem 13 extending outwardly therefrom which has a threaded portion 14. An adjustment nut 15 is threaded on portion 14 of stem 13, and a washer 20 is located between nut 15 and a spring retaining socket 17 which surrounds stem 13. The nut 15 is adjustable to vary the compressive force exerted on a spring 16 to preload the spring. The spring 16 is retained within socket 17 as shown in FIG. 1. Spring 16 and its associated mechanism form a part of the hinge and latch mechanisms for the closure.

The hinge and latch mechanisms are best shown in FIGS. 1 and 3 of the drawings. The hinge mechanism includes a pair of spaced substantially triangular shaped adapters 30 mounted on brackets 31 extending outwardly from pusher door 10. The brackets 31 may also be attached to transition member 6 or spacer 7. Each hinge bracket 31 has a hinge pin bore to receive a bolt 32 which is attached to a triangular adapter 30. The corner 30' of each adapter 30 abuts a flat edge formed on the bracket 31 carrying the adapter to prevent the adapter from pivoting relative to pusher door 10. Both adapters 30 carry a hinge assembly consisting of a pair of parallel links 33 pivotally attached to adapters 30 by pins 37. The links 33 are rigidly connected by a cross member 35 welded between them. The other ends of links 33 are pivotally attached to socket 17 by shoulder bolts 34 threaded into holes in socket 17 and held in place by cross pins or set screws. A pair of control arms 36 is attached to adapters 30 by pins 38 and are attached to rods 35. A pair of members 40 is attached to socket member 17 and a roller 18 is mounted at its free ends which is a part of the latch mechanism. Roller 18 cooperates with a locking lever 42 pivotally mounted on a latch bracket 41 which extends from pusher door 10 to lock the closure in the closed position. It will be understood by those skilled in the art the above described hinge mechanism may be provided with a different latch mechanism for the closure without departing from the scope of my invention.

The action of the hinge arrangement is important since it permits the closure to initially move in a direction parallel to the axis of the leveler opening for a short distance to engage or disengage the annular lip 2 from the annular extension 5 when the closure is closed and opened, respectively. After the lip and the extension are disengaged during opening, the closure swings about pins 37 and 38 in an angular path into the position shown in dotted lines in FIG. 1 of the drawings. In the areas where the closure of my invention will normally be used there is very little clearance for movement of the closure so that the closure must be movable in a minimum amount of space to swing completely free of the leveler opening to clear the smoke shield and to permit insertion of the leveler bar into the coke oven without risk of damaging the closure by collision with the leveler bar or the smoke shield. When used with a stand pipe cap the closure must swing free of the pipe mouth so that it is not contacted by flames issuing from the pipe.

The seal in the embodiment shown in FIG. 1 is caused by a tight contact between the sealing surface 3 of the lip 2 and the seat portion 4 of the extension 5. This is a cone seal and is located remote from the passage of effluent through the opening 9.

Figure 2:
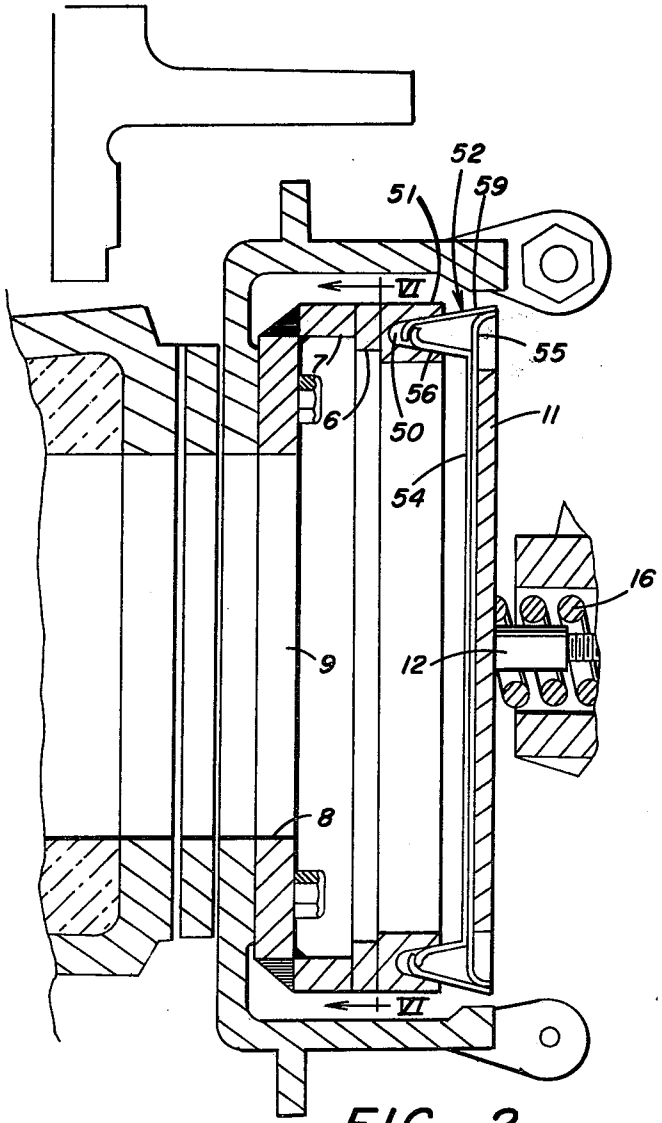
FIG. 2 is a horizontal section through a second embodiment of my invention with the hinge and latch mechanism omitted.

A preferred seal is shown in FIG. 2 wherein like parts have like reference numerals. The seal shown in FIG. 2 is a wedge seal and is formed by an annular groove 50 formed in extension 51 and a projection 52 located at the periphery of closure 53. As in the earlier embodiment, the seal is located away from the path of the effluents passing through opening 9 to minimize the accumulation of tar and condensate. The groove and the projection are shown in detail in FIG. 4 of the drawings. The closure 53 is shown as a pair of parallel members 54 and 55 which are attached along their base portions. A hub 11 is attached to member 55. Member 54 has an annular flexible projection 56 at its periphery having a hook-shaped end portion 57. Member 55 is dish-shaped and terminates in an outwardly directed annular flange 58. An annular inwardly directed flexible projection 59 is welded to flange 58. The end 60 of projection 59 overlies the portion 57 of projection 56. The projections 56 and 59 are hook-shaped in cross section and are not attached to each other so that when a compressive force is applied to door hub 11 by spring 16 and locking lever 42, the two projections cooperate as interacting sealing elements. Projection 59 is forced into groove 50 by projection 57 and a tight seal is obtained between the projections and the complementary surfaces of inflexible groove 50.

Figure 4:
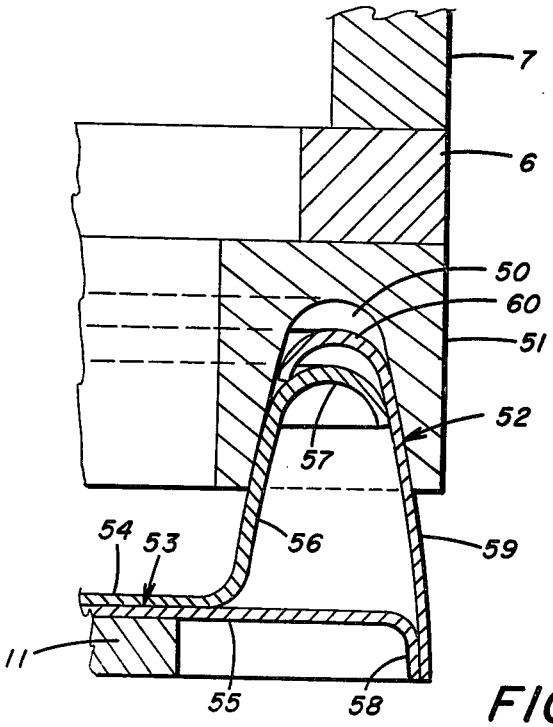
FIG. 4 is an enlarged view of the wedge seal of FIG. 2.
Figure 8:
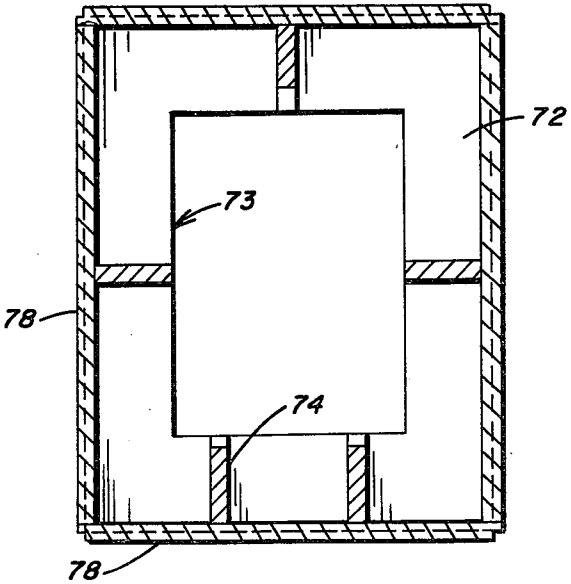
FIG. 8 is a section on lines VIII—VIII of FIG. 7.
Figure 7:
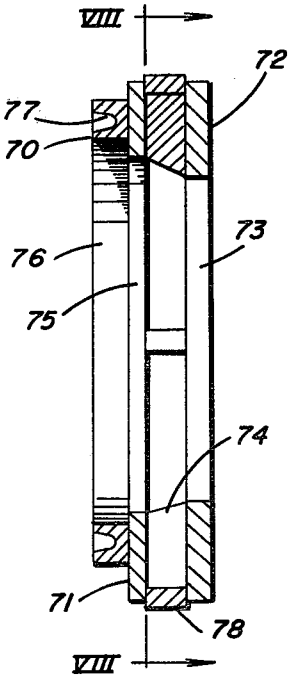
FIG. 7 is a section on lines VII—VII of FIG. 6.
Figure 6:
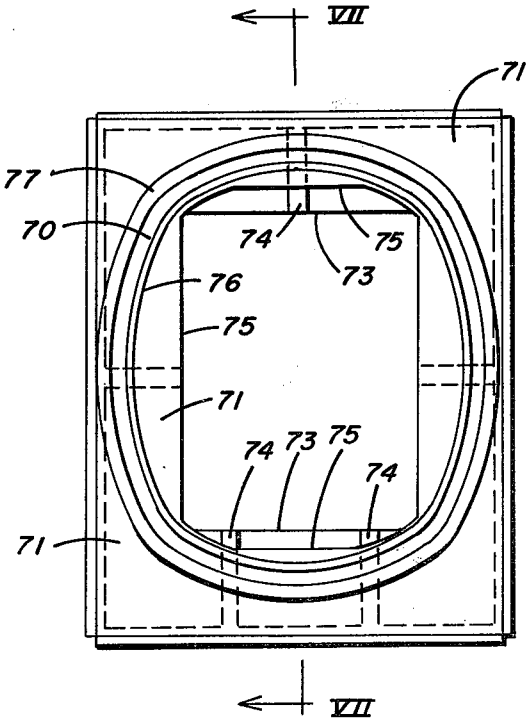
FIG. 6 is an elevation view of a leveler opening having an oval extension.

FIG. 6 of the drawing shows an oval-shaped opening 76 defined by an extension 70 which is mounted on a transition member 71. The opening in the pusher door and the opening 73 in the member 72 which is bolted to the pusher door are rectangular. As seen in FIGS. 7 and 8, a plurality of spaced ribs 74 is welded to member 72 around opening 73. The ribs extend from member 72 in a direction parallel to the axis of opening 73 in member 72. The number and location of the ribs are not critical so long as there are sufficient ribs to provide a strong connection between the member 72 and transition member 71 which is welded to the edges of ribs 74. The transition member contains an opening 75 which is smaller than opening 73 formed by member 72. The oval-shaped extension 70 encompasses opening 75 and has a groove 77 which is the seat portion of a wedge seal in the same manner as shown in FIGS. 2 and 4. Edge members 78 are welded between members 71 and 72 and to the outer edges of the ribs 74. It will be understood by those skilled in the art that the wedge seal in the embodiment shown in FIGS. 6–8 functions in the same way as the wedge seal shown in FIGS. 2 and 4. The major difference between the embodiments of FIGS. 6–8 and FIG. 2 is that in FIGS. 6–8 opening 76 is oval-shaped to accommodate a rectangular opening in the pusher door for the leveler bar, and ribs are located between members 71 and 72. The mechanism for hinging and latching the closure will be the same as shown in FIGS. 1 and 3.

It will be understood that while the invention has been described with respect to a door for a coke oven leveler opening and a stand pipe cap, the sealing arrangement can be used to close any opening in a wall of a furnace combustion chamber or a distillation chamber wherein effluents are created by reactions taking place in the chamber and a positive seal is required. It should also be understood that, while the closure has been shown and described as circular or oval in configuration, other shapes may also be used. Large doors may be square or rectangular in configuration so long as the corners are rounded with a substantial radius.

While preferred embodiments of my invention have been described herein, it will be understood that modifications may be made without departing from the scope of the invention as defined by the appended claims.

I claim:

1. In a coke oven having at least one opening therein and a closure for said opening, said closure and said opening having mating surfaces associated therewith for removably sealing said opening, the improvement comprising:

one of said surfaces having a lip extending from its periphery and a flexible metal sealing surface on said lip;

said flexible metal sealing surface including a pair of hook-shaped projections with one of said hook-shaped projections enveloping a portion of the other of said hook-shaped projections;

the other of said mating surfaces having an extension at its periphery, said extension having an inflexible metal seating groove for receiving said flexible metal sealing surface to seal said opening;

the mating surface associated with said opening being located remote from the line of discharge through said opening, said seating groove and said lip sealing surface providing a metal to metal seal;

hinge means attached to said closure, mounting said closure adjacent said opening, and permitting said closure to move relative to said opening; and locking means attached to said closure to engage means adjacent said opening to move said lip into sealing engagement with said seating groove to seal said opening.

2. The coke oven of claim 1 wherein said surface having the lip extending from its periphery is said closure.

3. In a coke oven having an elongated vertical pusher door, a leveler opening formed in the upper end of said pusher door adapted to receive a leveler bar for leveling coal in the oven, the improvement comprising:

a transition member surrounding said leveler opening for changing the configuration of said leveler opening;

an extension attached to said transition member defining an opening;

a closure for said opening, said closure having a central portion and a flexible metal sealing surface on said lip, said flexible metal sealing surface including a pair of hook-shaped projections with one of said hook-shaped projections enveloping a portion of the other of said hook-shaped projections, said extension having an inflexible metal seating groove for contact with said sealing surface of said lip to seal said opening with a metal to metal seal, and said metal seating groove being remote from the line of discharge through said opening;

hinge means attached to said central portion of said closure and mounting said closure adjacent to said opening and permitting said closure to move relative to said extension;

locking means attached to said closure to engage means adjacent to said opening to move said sealing surface of said lip into engagement with said seating groove on said extension to seal said opening.

4. Apparatus as set forth in claim 3 including spacer means between said transition member and said pusher door, said spacer means attached to said pusher door and said transition member attached to said spacer means, means attached to said pusher door supporting said hinge means and other means attached to said pusher door for contacting said locking means on said closure to force said lip into engagement with said set portion on said extension.

5. Apparatus as set forth in claim 4 wherein said spacer means is an annular member.

6. Apparatus as set forth in claim 4 including a member attached to said pusher door having an opening corresponding to said leveler opening, said spacer means consisting of a plurality of spaced ribs attached at one edge to said transition member and at the other edge to said member attached to said door and edge members extending between the outer periphery of said transition member and the outer periphery of said member attached to said pusher door to form a passageway between said leveler opening in said pusher door and the opening in said extension.

7. Apparatus as set forth in claim 3 wherein said opening defined by said transition member is a circle.

8. Apparatus as set forth in claim 3 wherein said opening defined by said extension member is an oval.

9. Apparatus as set forth in claim 3 wherein said hinge means includes a spring for applying a force to said closure and adjustment means attached to said closure for adjusting the amount of force applied to said closure by said spring.

10. An apparatus adapted to removably close and seal an opening in a furnace member comprising:

a first member adapted to be attached to said furnace member;

at least one spacer attached to said first member;

a transition member attached to said spacer and defining an opening having a configuration different from the opening in said furnace member;

an extension attached to said transition member and defining an opening having the same configuration as said opening defined by said transition member;

an inflexible metal seating groove on said extension;

a closure for said opening defined by said extension, said closure having a flexible metal sealing means for contacting said seating groove on said extension to close and seal said opening defined by said extension with a metal to metal seal;

said flexible metal sealing means including a pair of hook-shaped projections with one of said hook-shaped projections enveloping a portion of the other of said hook-shaped projections;

said closure being mounted on a hinge means extending from said transition member, said member attached to said furnace member;

said spacer, said transition member and said extension forming an elongated passageway;

and said seating groove on said extension being located out of proximity from a line of discharge through said passageway whereby the metal to metal seal between said seating groove and said sealing means of said closure is remote from said line of discharge through said passageway.

11. In a coke oven having at least one opening and a closure for said opening the improvement comprising:

said closure having a central portion and a pair of hook-shaped projections extending from the central portion of the periphery of said closure, one of said hook-shaped projections enveloping a portion of the other of said hook-shaped projections;

an extension forming a part of said opening, said extension having an inflexible seating groove for receiving said projections to seal said opening, and said metal seating groove being located remote from the line of discharge through said opening;

said projections and said metal seating groove providing a metal to metal seal;

hinge means attached to said closure mounting, said closure adjacent to said opening formed by said extension and permitting said closure to move relative to said extension;

and locking means attached to said closure to engage means adjacent said opening to move said projections into sealing engagement with said groove on said extension to seal said opening.

12. Apparatus as set forth in claim 11 including a hub welded to said central portion of said closure, a rod attached to said hub, spring means surrounding said rod and contacting said hub, socket means having an open end adjacent said hub and a closed end spaced from said hub surrounding said spring means and said rod and an adjustment member on said rod adjacent to the closed end of said socket means for moving said socket means and said spring means relative to said hub to adjust the compressive force applied to said hub by said spring means.

13. Apparatus as set forth in claim 12 wherein said hinge means includes links attached to said socket means at one end and to adapters at the other end, said adapters mounted adjacent to said opening, and said adapters provided to permit said closure to move initially, upon opening, in a direction parallel to the axis of said opening;

control arms attached to said adapters at one end and to said socket means at the other end and said locking means including a pair of members attached to said socket means; and a roller supported on said members, said roller adapted to be contacted by a latching lever to force said lip into sealing engagement with said seating groove.

* * * * *